US008207457B2

(12) United States Patent
Twibell et al.

(10) Patent No.: US 8,207,457 B2
(45) Date of Patent: Jun. 26, 2012

(54) REVERSING AND A METHOD OF MODIFYING A TAP CHANGER TO USE THE SAME

(75) Inventors: Brian E. Twibell, Hermitage, TN (US); Bruce W. Nichols, Dallas, TX (US)

(73) Assignee: ABB Technology AG, Zurich (CH)

( * ) Notice: Subject to any disclaimer, the term of this patent is extended or adjusted under 35 U.S.C. 154(b) by 424 days.

(21) Appl. No.: 12/648,447

(22) Filed: Dec. 29, 2009

(65) Prior Publication Data

US 2011/0000769 A1 Jan. 6, 2011

Related U.S. Application Data

(60) Provisional application No. 61/141,135, filed on Dec. 29, 2008.

(51) Int. Cl.
*H01H 19/00* (2006.01)
*H01H 21/00* (2006.01)

(52) U.S. Cl. ..... 200/11 TC

(58) Field of Classification Search ..... 200/11 TC
See application file for complete search history.

(56) References Cited

U.S. PATENT DOCUMENTS

| | | | |
|---|---|---|---|
| 2,947,837 | A | 8/1960 | Baguhn |
| 3,045,090 | A | 7/1962 | Wilson, Jr. et al. |
| 3,366,763 | A | 1/1968 | Bleibtreu et al. |
| 3,641,300 | A | 2/1972 | Nitz |
| 4,931,599 | A | 6/1990 | Bleibtreu |
| 4,935,586 | A | 6/1990 | Bleibtreu et al. |
| 4,939,319 | A | 7/1990 | Bleibtreu |
| 4,978,815 | A | 12/1990 | Berger et al. |
| 5,034,578 | A | 7/1991 | Lauterwald |
| 5,107,200 | A | 4/1992 | Dohnal et al. |
| 5,315,078 | A | 5/1994 | Freymuller |
| 5,604,424 | A | 2/1997 | Shuttleworth |
| 5,960,939 | A | 10/1999 | Miki et al. |
| 6,060,669 | A | 5/2000 | Dohnal et al. |
| 6,091,032 | A | 7/2000 | Dohnal et al. |
| 6,495,779 | B1 | 12/2002 | Dobler et al. |
| 6,849,813 | B1 | 2/2005 | Albrecht |

FOREIGN PATENT DOCUMENTS

| | | | |
|---|---|---|---|
| DE | 1763312 | A1 | 7/1971 |
| DE | 2620211 | A1 | 12/1977 |
| DE | 3719680 | A1 | 2/1988 |
| EP | 0907192 | A2 | 4/1999 |
| WO | 2010078292 | A1 | 7/2010 |

*Primary Examiner* — Renee Luebke
*Assistant Examiner* — Lheiren Mae Caroc
(74) *Attorney, Agent, or Firm* — Paul R. Katterle

(57) ABSTRACT

A reversing switch for a tap changer of a transformer is provided. The reversing switch includes first and second contact structures for connection to a winding of the transformer and a mounting structure for connection to a neutral terminal of the transformer. A bus bar connects a third contact structure to the mounting structure. A movable contact arm is secured to a rotatable post. The contact arm includes a contact assembly mounted to an arm. The contact assembly has one or more outward contacts and one or more inward contacts. The one or more inward contacts engage the third contact structure and the one or more outward contacts selectively engage the first contact structure or the second contact structure. The first and second contact structures and the mounting structure are located at about the same radial distance from the post, while the third contact structure is located closer to the post.

20 Claims, 9 Drawing Sheets

REVERSING AND A METHOD OF MODIFYING A TAP CHANGER TO USE THE SAME

CROSS-REFERENCE TO RELATED APPLICATION

This application claims the benefit of U.S. provisional patent application No. 61/141,135 filed on Dec. 29, 2008, which is hereby incorporated by reference in its entirety.

BACKGROUND OF THE INVENTION

This invention relates to load tap changers and more particularly to reversing switches for load tap changers.

As is well known, a transformer converts electricity at one voltage to electricity at another voltage, either of higher or lower value. A transformer achieves this voltage conversion using a primary coil and a secondary coil, each of which are wound on a ferromagnetic core and comprise a number of turns of an electrical conductor. The primary coil is connected to a source of voltage and the secondary coil is connected to a load. Voltage present on the primary coil is induced on the secondary coil by a magnetic flux passing through the core. The voltages induced on each turn of the secondary coil are cumulative and therefore the voltage output from the secondary coil is proportional to the strength of the magnetic flux and the number of turns in the secondary coil. Since the amount of magnetic flux generated by the primary coil is proportional to the number of turns in the primary coil and the voltage produced by the secondary coil is proportional to the magnetic flux surrounding the secondary coil, the output voltage of the transformer is generally equal to the input voltage times the ratio of the number of turns in the primary coil over the number of turns in the secondary coil. Thus, by changing the ratio of primary turns to secondary turns, the ratio of input to output voltage can be changed, thereby controlling or regulating the output voltage of the transformer. This ratio can be changed by selectively connecting the load to different connection points or "taps" located at different turns of the secondary coil. A device that can make such selective connections to the taps of a secondary coil is referred to as a "tap changer". Typically only a portion of the secondary coil is tapped.

Generally, there are two types of tap changers: on-load tap changers and de-energized or "off-load" tap changers. De-energized tap changers use circuit breakers to isolate the transformer from the voltage source and then switches the load (output) manually from one coarse adjustment tap to another. An on-load tap changer (or simply "load tap changer") switches the load connection between taps while the transformer is connected to the voltage source. On-load tap changers typically include a plurality of selector switch contacts and, depending upon the type of load tap changer, either a selector switch with contacts that both make and break the current during tap changes or a transfer or diverter switch. The selector switch contacts correspond to a desired tap, while the diverter or transfer switch connects the desired tap to the load. In the latter, the selector switch contacts make a new tap connection before disconnecting an old tap connection, i.e., short circuits the taps. In order to avoid a high circulating current between the taps, the diverter switch temporarily places large impedance (using resistors or reactors) in series with the short-circuited taps to avoid high circulating currents between the short-circuited taps. The selector switch contacts may or may not perform any switching operations between contacts carrying current. The diverter, or transfer switch, however, does make and break connections between contacts carrying current.

In addition to the selector switch contacts and the diverter or transfer switch, a load tap changer often also includes a reversing switch, which is operable to change the polarity of the terminals of the tapped portion of the secondary winding. A change in polarity causes the voltage generated in the tapped portion of the secondary winding to either boost (increase) or buck (decrease) the voltage across the un-tapped portion of the secondary winding, depending on the position of the reversing switch. A reversing switch typically includes first and second contacts respectively connected to opposite ends of the series winding and a third contact member connected to a neutral terminal of the transformer. A movable contact assembly is operable to connect the third contact to the first contact or the second contact.

Some conventional reversing switches, particularly certain types of older ones, are susceptible to heating and coking, which can cause transformer outages and failures. Accordingly, reversing switches of certain types typically have to be replaced often during the life of a transformer. As can be appreciated, replacing a reversing switch or the entire load tap changer is expensive. Therefore, it would be desirable to provide a load tap changer with an improved reversing switch and a method of retrofitting an existing load tap changer to have an improved reversing switch. The present invention is directed toward such a load tap changers and method.

SUMMARY OF THE INVENTION

In accordance with the present invention, a reversing switch for a tap changer of a transformer is provided. The reversing switch includes a rotatable post and first and second contact structures for connection to a winding of the transformer. A mounting structure is provided for connection to a neutral terminal of the transformer. A bus bar connects a third contact structure to the mounting structure. The third contact structure is located closer to the post than the first and second contact structures and the mounting structure. A movable contact arm is secured to the post and is movable therewith between first and second positions. The contact arm includes a contact assembly mounted to an arm.

In one aspect of the present invention, the contact assembly has one or more outward contacts and one or more inward contacts. The one or more inward contacts engages the third contact structure and the one or more outward contacts engages the first contact structure when the contact arm is in the first position and engages the second contact structure when the contact arm is in the second position. The first contact structure, the second contact structure and the mounting structure are arranged in an arc, with the first contact structure, the second contact structure and the mounting structure each being located at about the same radial distance from the post.

In another aspect of the present invention, the contact assembly includes a plurality of contact jaw pairs. Each contact jaw pair has an inner end and an outer end and includes an upper contact jaw aligned over a lower contact jaw. The third contact structure is disposed between the upper and lower contact jaws at the inner end of each contact jaw pair. When the contact arm is in the first position, the first contact structure extends between the upper and lower contact jaws at the outer end of each contact jaw pair. When the contact arm is in the second position, the second contact structure extends between the upper and lower contact jaws at the outer end of each contact jaw pair.

Also provided in accordance with the present invention is a method of modifying a tap changer of a transformer to replace a first reversing switch with a second reversing switch. The first reversing switch includes a contact arm mounted to a mounting plate of the tap changer and movable about an axis. The first reversing switch also includes first and second contact structures mounted to the mounting plate and connected to a winding of the transformer. A third contact structure is mounted to the mounting plate and is connected to a neutral terminal of the transformer. In accordance with the method, the contact arm, the second contact structure and the third contact structure of the first reversing switch are removed from the mounting plate of the tap changer. A first contact structure of the second reversing switch is secured to the mounting plate at about the same location as where the first contact structure of the first reversing switch was mounted to the mounting plate. A second contact structure of the second reversing switch is secured to the mounting plate at about the same location as where the second contact structure of the first reversing switch was mounted to the mounting plate. A mounting structure of the second reversing switch is secured to the mounting plate at about the same location as where the third contact structure of the first reversing switch was mounted to the mounting plate. A third contact structure of the second reversing switch is secured to the mounting structure with a bus bar. The first and second contact structures of the second reversing switch are connected to the winding of the transformer. The mounting structure of the second reversing switch is connected to the neutral terminal of the transformer. A contact arm of the second reversing switch is connected to the mounting plate so as to be pivotable about the axis between first and second positions. The contact arm includes a contact assembly mounted to an arm. The contact assembly has one or more outward contacts and one or more inward contacts. When the second reversing switch is fully installed, the one or more inward contacts engage the third contact structure and the one or more outward contacts engage the first contact structure when the contact arm is in the first position and engage the second contact structure when the contact arm is in the second position.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
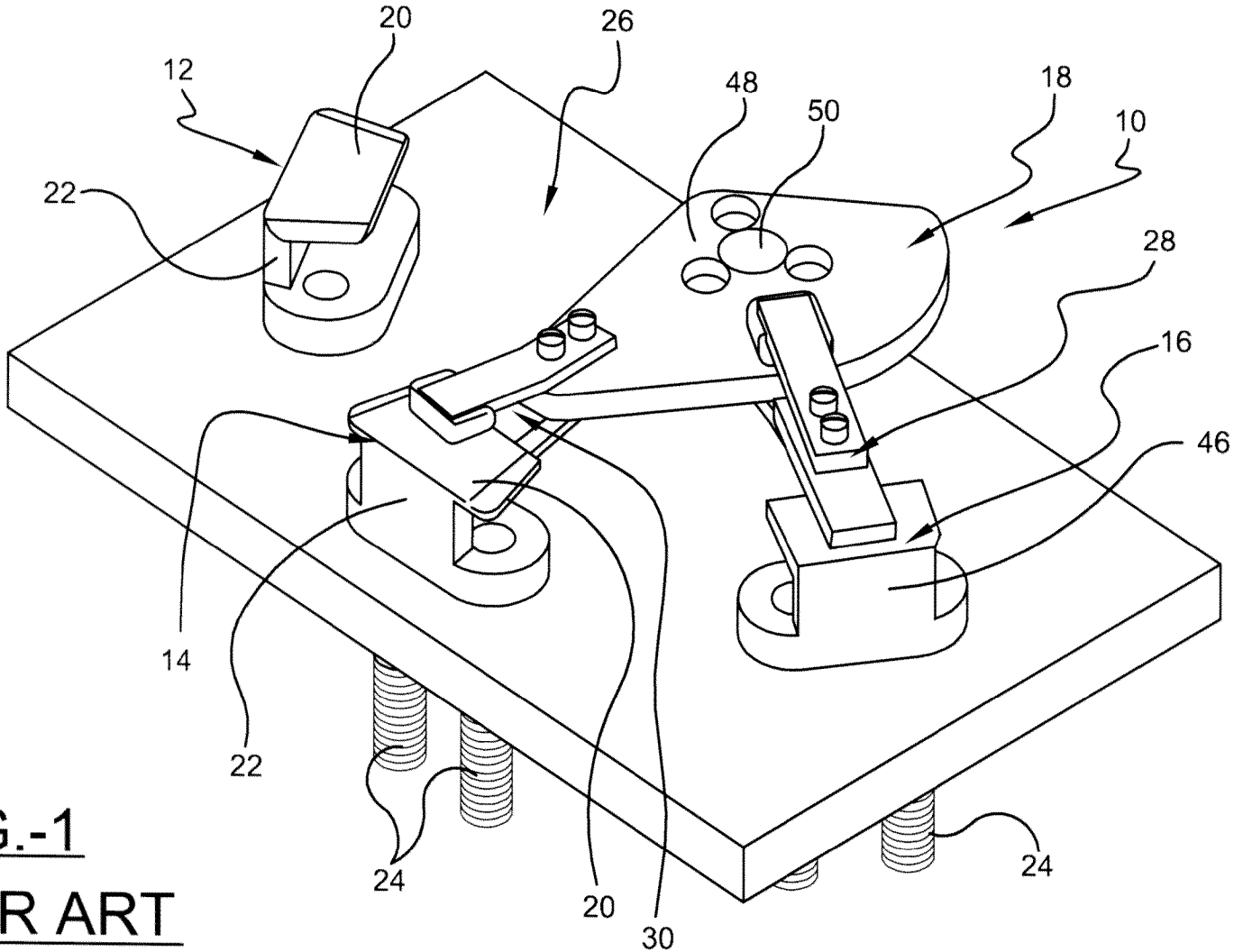
FIG.-1 PRIOR ART
FIG. 1 shows a top perspective view of a first prior art reversing switch.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

First Prior Art Reversing Switch

Figure 2:
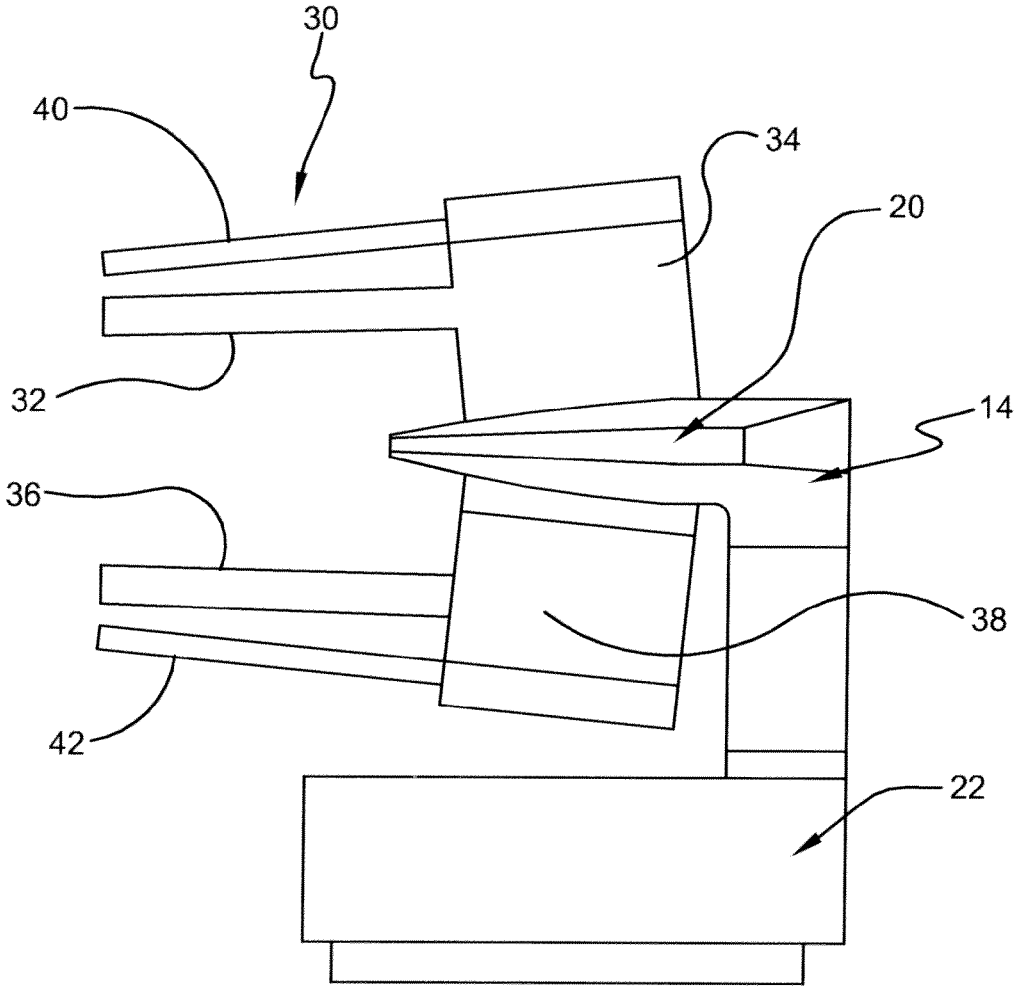
FIG.-2 PRIOR ART
FIG. 2 shows an enlarged side view of a portion of the first prior art reversing switch.

Referring now to FIGS. 1-2, there is shown a first prior art reversing switch 10 for a first load tap changer of a transformer. The first prior art reversing switch 10 includes a first contact structure 12, a second contact structure 14, a third contact structure 16 and a movable contact arm 18. The first and second contact structures 12, 14 are electrically connected to opposite ends of a series winding of the transformer, respectively, while the third contact 16 is connected to a neutral terminal of the transformer. The first and second contact structures 12, 14 each have a wedge-shaped contact 20 mounted in cantilever fashion to a support 22, which is mounted by a pair of threaded metal rods 24 to a mounting plate 26. The mounting plate 26 is composed of an insulating material, such as a composite comprising a phenolic or other type of resin. The rods 24 extend through mounting openings in the mounting plate 26 and may provide the electrical connections between the first and second contact structures 12, 14 and the ends of the series winding, respectively.

The third contact structure 16 includes an arm assembly 28 and the movable contact arm 18 includes an arm assembly 30. The arm assemblies 28, 30 each comprise an upper arm 32 having a first end with an upper contact 34 secured thereto and a lower arm 36 having a first end with a lower contact 38 secured thereto. An upper leaf spring 40 biases the upper arm 32 downwardly, while a lower leaf spring 42 biases the lower arm 36 upwardly. In this manner, the upper and lower contacts 34, 38 are biased towards each other. With regard to the arm assembly 28 of the third contact structure 16, second ends of the upper and lower arms 32, 36 are fixed to a stationary support 46, whereas with regard to the arm assembly 30 of the movable contact arm 18, second ends of the upper and lower arms 32, 36 are fixed to a movable contact plate 48. The stationary support 46 is mounted to the mounting panel 26 by a pair of the metal rods 24, which extend through mounting openings in the mounting plate 26 and may provide the electrical connection between the third contact structure 16 and the neutral terminal. The upper and lower contacts 34, 38 of the arm assembly 28 of the third contact structure 16 respectively engage upper and lower surfaces of the contact plate 48, thereby electrically connecting the contact arm 18 to the third contact structure 16 and, thus, the neutral terminal of the transformer.

The contact plate 48 is secured to a post 50, which is journaled through an opening in the mounting plate 26. The post 50 is connected to an actuation device of the first load tap changer, which is operable to rotate the post 50 so as to move the contact plate 48 between first and second positions. As the contact plate 48 moves between the first and second positions, the arm assembly 28 of the third contact structure 16 maintains electrical contact with the contact plate 48, with the upper and lower contacts 34, 38 of the arm assembly 28 respectively sliding over the upper and lower surfaces of the contact plate 48. In the first position, the upper and lower contacts 34, 38 of the arm assembly 30 of the movable contact arm 18 respectively engage upper and lower surfaces of the contact 20 of the first contact structure 12, thereby electrically connecting the first contact structure 12 to the contact plate 48 and, thus, the neutral terminal. In the second position, the upper and lower contacts 34, 38 of the arm assembly 30 of the movable contact arm 18 respectively engage upper and lower surfaces of the contact 20 of the second contact structure 14, thereby electrically connecting the second contact structure 14 to the contact plate 48 and, thus, the neutral terminal.

The first and second contact structures 12, 14 and the support 46 are arranged in an arc, with each of the foregoing being located at about the same radial distance from the post 50.

Second Prior Art Reversing Switch

Figure 3:
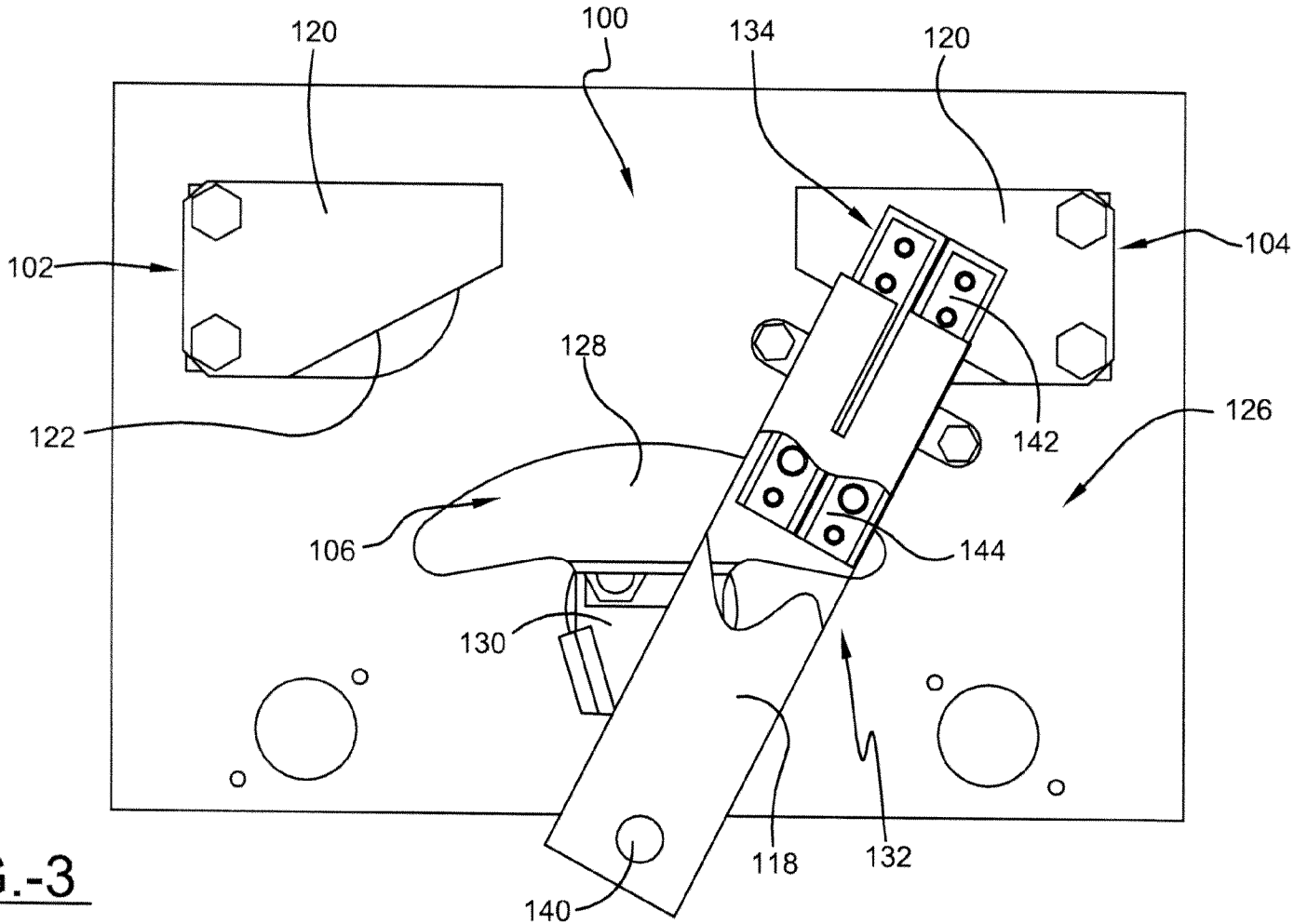
FIG.-3 PRIOR ART
FIG. 3 shows a top plan view of a second prior art reversing switch.

Referring now to FIG. 3, there is shown a second prior art reversing switch 100 for a load tap changer of a transformer. The second prior art reversing switch 100 includes a first contact structure 102, a second contact structure 104, a third contact structure 106 and a movable arm assembly 132. The first and second contact structures 102, 104 are electrically connected to opposite ends of a series winding of the transformer, respectively, while the third contact 106 is connected to a neutral terminal of the transformer. The first, second and third contact structures 102, 104, 106 are arranged in a generally triangular configuration. The first and second contact structures 102, 104 each have contact plates 120 mounted in cantilever fashion to a support 122, which is mounted by one or more threaded bolts or rods to a mounting plate 126. The mounting plate 126 is composed of an insulating material, such as a composite comprising a phenolic or other type of resin. The third contact structure 106 includes a curved contact plate 128 mounted in cantilever fashion to a support 130. The arm assembly 132 includes an arm 118 carrying a contact assembly 134. The arm 118 is secured to a post 140, which is journaled through an opening in the mounting plate 126. The post 140 is connected to an actuation device of the second load tap changer, which is operable to rotate the post 140 so as to move the arm assembly 132 between first and second positions. The contact assembly 134 includes a set of outward contacts 142 and a set of inward contacts 144. The inward contacts 144 engage the curved contact plate 128 of the third contact structure 106, while the outward contacts 142 selectively engage the contact plate 120 of either the first contact structure 102 or the second contact structure 104, as will be described.

As the arm assembly 132 moves between the first and second positions, the contact assembly 134 maintains electrical contact with the curved contact plate 128, with the inward contacts 144 sliding over the curved contact plate 128. In the first position, the outward contacts 142 engage the contact plate 120 of the first contact structure 102, thereby electrically connecting the first contact structure 102 to the curved contact plate 128 and, thus, the neutral terminal. In the second position, the outward contacts 142 engage the contact 20 of the second contact structure 104, thereby electrically connecting the second contact structure 104 to the curved contact plate 128 and, thus, the neutral terminal.

First Retrofit Method

In accordance with the present invention, a first retrofit method is performed on the first load tap changer to replace the first prior art reversing switch 10 with a first retrofit reversing switch 150. The retrofit method begins with the removal of the first prior art reversing switch 10. The rods 24 are unthreaded from the first, second and third contact structures 12, 14, 16 and the mounting plate 26. The first, second and third contact structures 12, 14, 16 are then removed. The contact arm 18 is removed from post 50 or the post 50 is disconnected from the actuation device of the first load tap changer and both the post 50 and the contact arm 18 are removed. Once the first prior art reversing switch 10 is removed, the mounting plate 26 may be cleaned with a solvent or other washing fluid to remove any coking or other debris.

Figure 4:
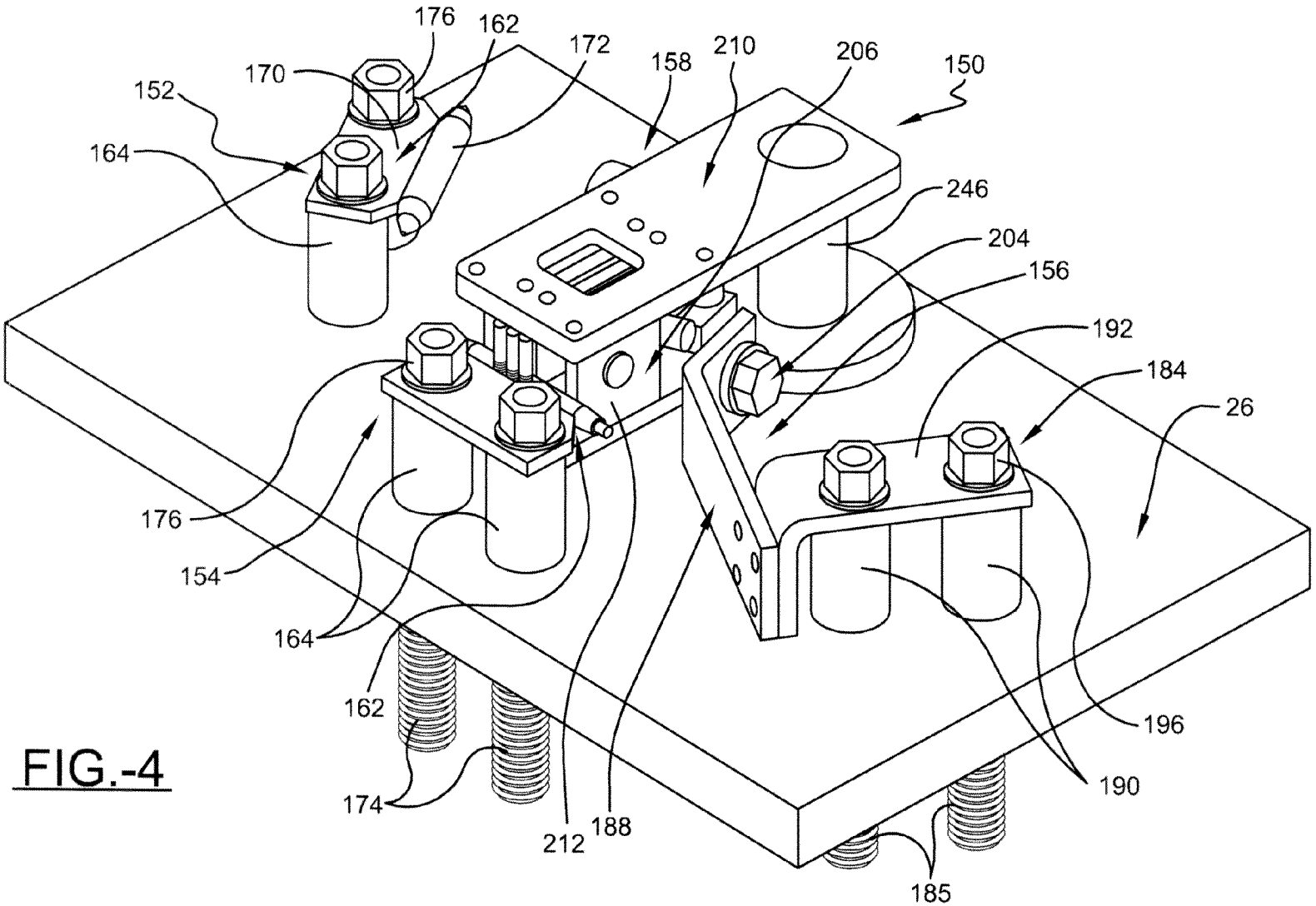
FIG. 4 shows a top perspective view of a first retrofit reversing switch constructed in accordance with a first embodiment of the present invention.
Figure 5:
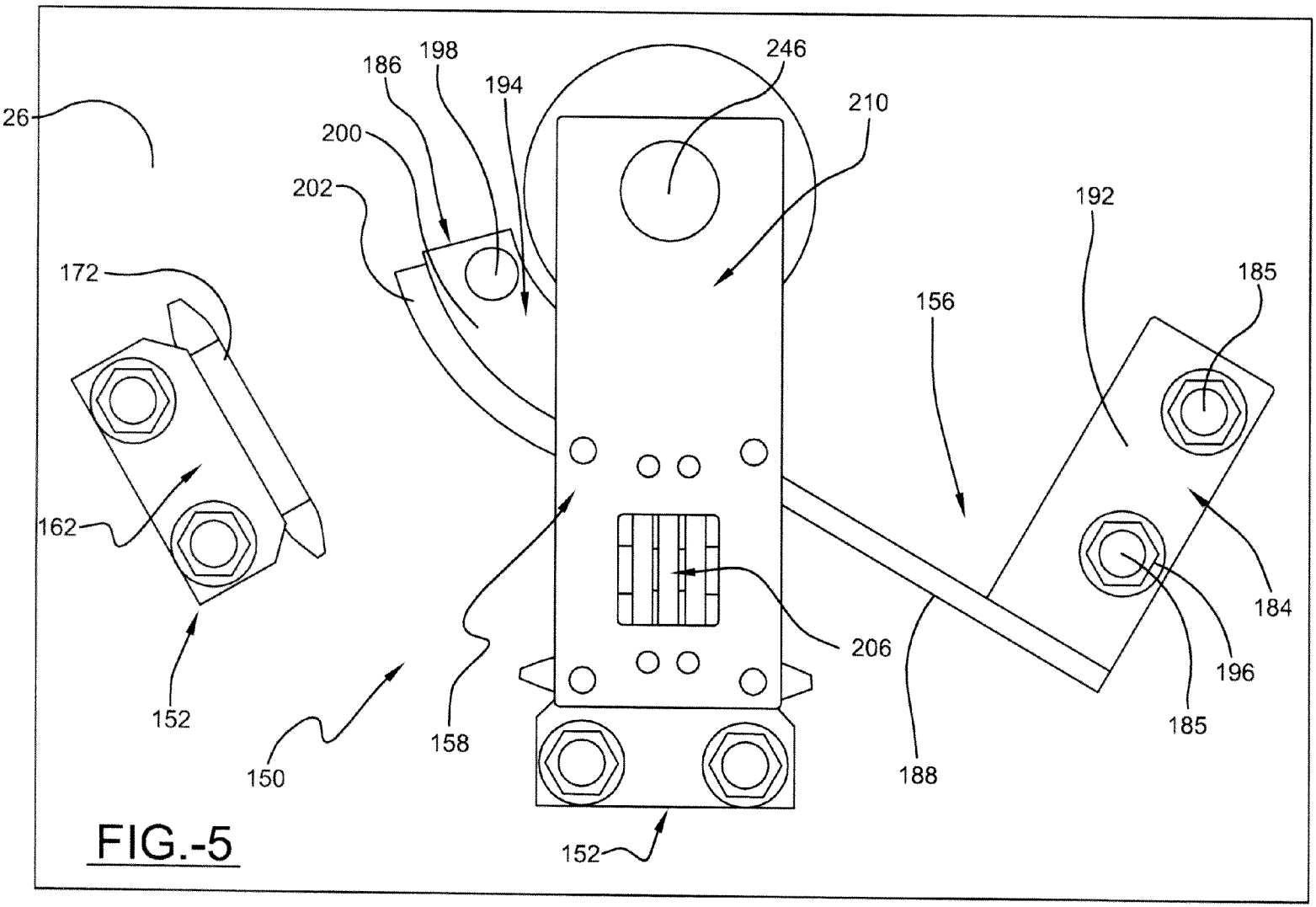
FIG. 5 shows a top plan view of the first retrofit reversing switch constructed in accordance with the first embodiment.
Figure 6:
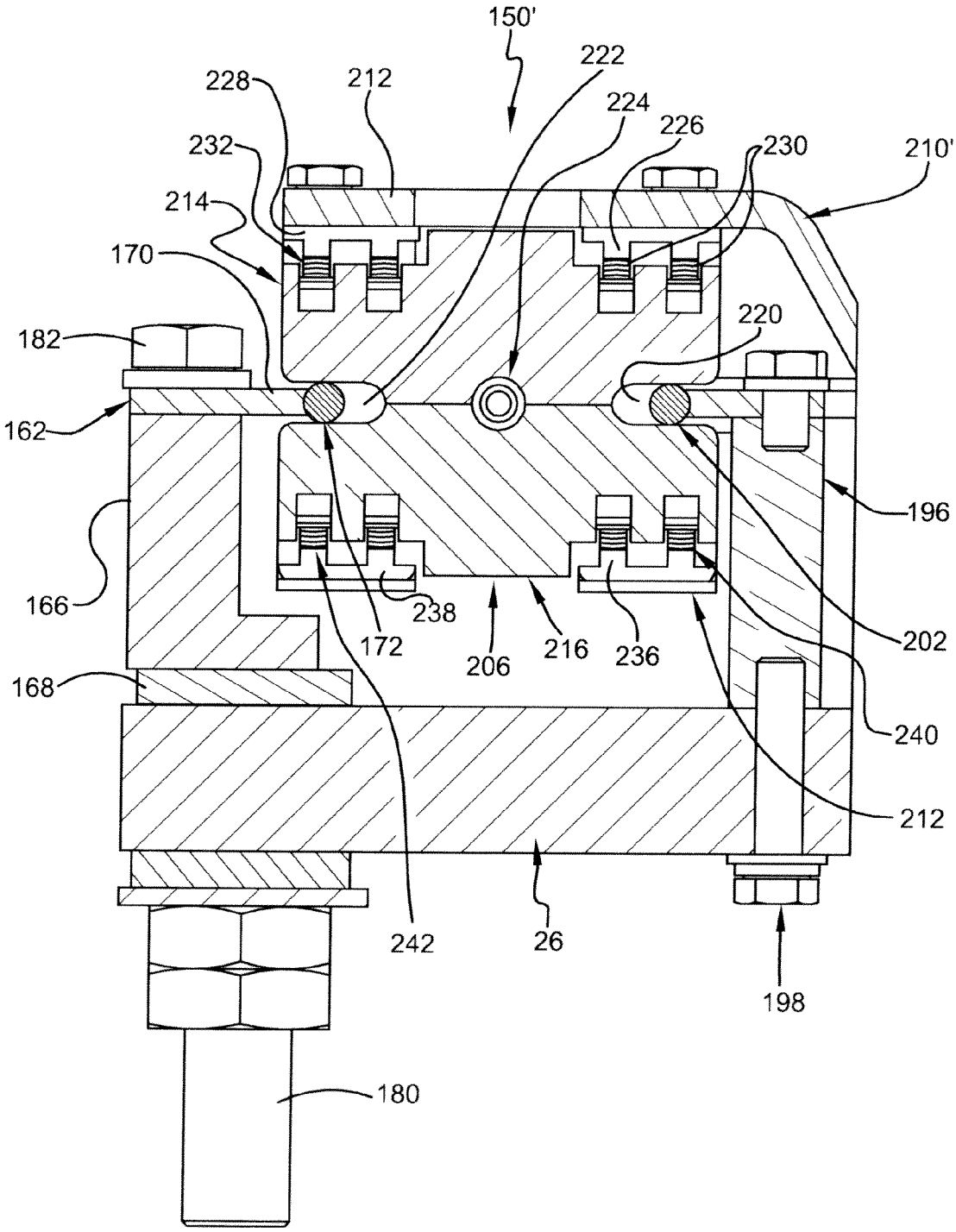
FIG. 6 shows a side sectional view of the first retrofit reversing switch constructed in accordance with a second embodiment of the present invention.
Figure 7:
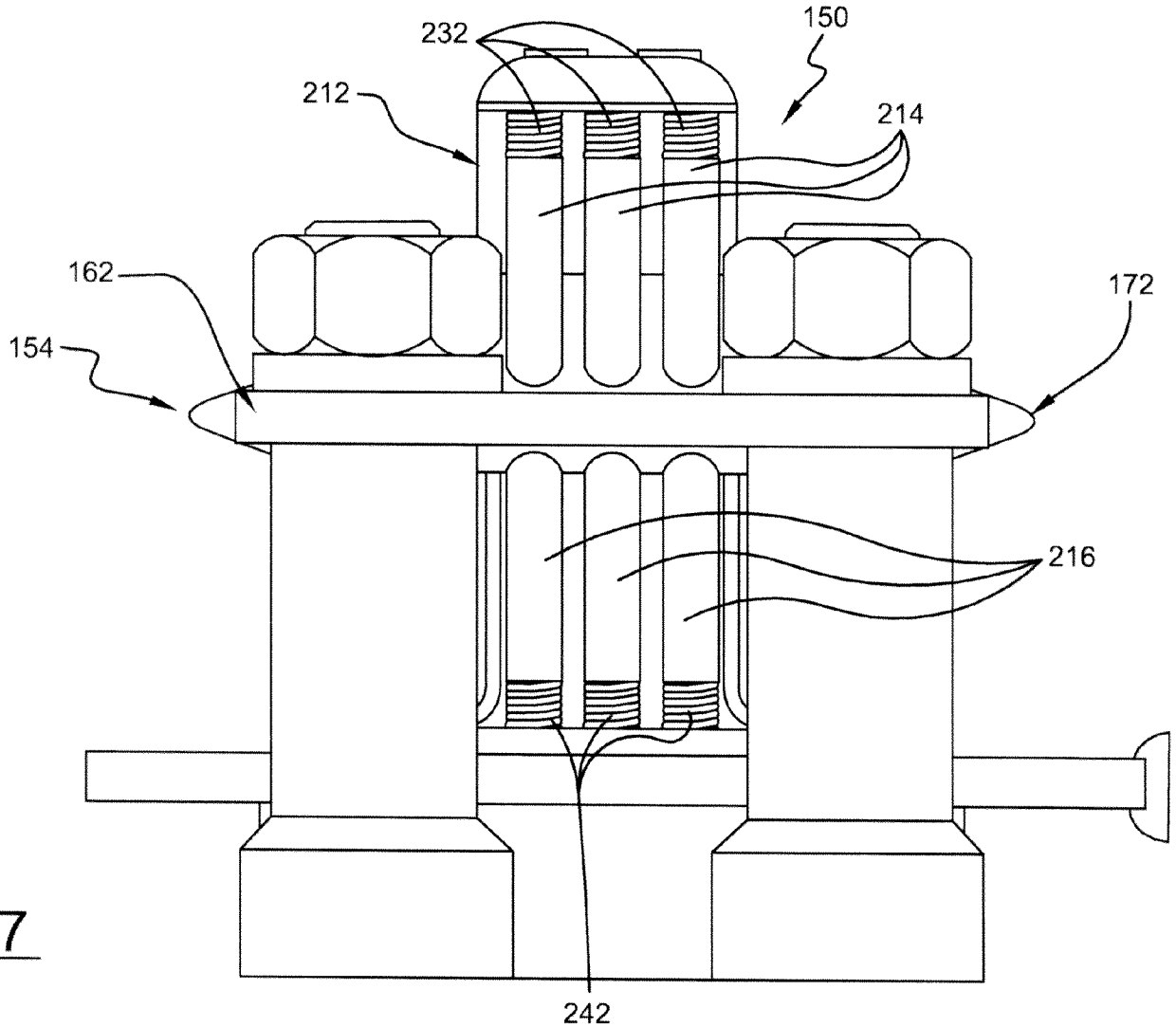
FIG. 7 shows a front elevation view of a portion of the first retrofit reversing switch constructed in accordance with the first embodiment, wherein a front portion of a retrofit contact arm is cut away to better show upper and lower jaws mounted therein.

Once the first prior art reversing switch 10 is removed from the first load tap changer, the components of the first retrofit reversing switch 150 are mounted to the mounting plate 26. Referring now to FIGS. 4-7, the first retrofit reversing switch 150 generally includes a first retrofit contact structure 152, a second retrofit contact structure 154, a bus bar structure 156 and a movable retrofit contact arm 158, all of which may be provided as a kit. A first embodiment of the first retrofit reversing switch (designated 150) is shown in FIGS. 4 and 5, while a second embodiment of the first retrofit reversing switch (designated 150') is shown in FIG. 6. Similar components in the two embodiments have the same reference numeral, but are differentiated by the prime mark. Identical components in the two embodiments have the same reference numeral. When reference is made to features common to both embodiments the reference numeral without the prime is utilized.

The first retrofit contact structure 152 is mounted at the same location as the first contact structure 12, using the same mounting holes in the mounting plate 26, while the second retrofit contact structure 154 is mounted at the same location as the second contact structure 14, using the same mounting holes in the mounting plate 26. The first and second retrofit contact structures 152, 154 are constructed of conductive metal and each include a contact head 162 mounted in cantilever fashion to a support. The support may comprise a pair of cylindrical mounts 164, as is the case in the first embodiment best shown in FIG. 4. Alternately, the support may be a unitary, generally L-shaped structure 166 adjoining a pad 168, as is the case in the second embodiment shown in FIG. 6. The contact head 162 is comprised of a metal, such as copper and may optionally be covered with one or more other metallic coatings, such as silver. The contact head 162 includes a plate 170 joined to a cylindrical contact 172 having tapered ends. In the first embodiment, the first and second retrofit contact structures 152, 154 may be mounted to the mounting plate 26 by threaded rods 174, which extend downwardly through the contact heads 162, the mounts 164 and the mounting holes in the mounting plate 26, as shown in FIGS. 4 and 5. A pair of nuts 176 are threaded onto each of the rods 174, on opposite sides of the mounting plate 26, to secure the first and second retrofit contact structures 152, 154 to the mounting plate 26 and to secure the contact heads 162 to the mounts 164. In the second embodiment, the structure 166 may be mounted to the mounting plate 26 by rods 180 that extend upwardly through the mounting holes in the mounting plate 26 and thence into threaded cavities in the structure 166, as shown in FIG. 6. Bolts 182 may secure the contact heads 162 to the structure 166. The rods 174, 180 may also provide the electrical connections between the first and second retrofit contact structures 152, 154 and the ends of the series winding, respectively.

As best shown in FIG. 5, the bus bar structure 156 generally includes a mounting structure 184, a third retrofit contact structure 186 and a bus bar 188, all of which are comprised of a conductive metal, such as copper.

The mounting structure 184 is mounted at the same location as the third contact structure 16, using the same mounting holes in the mounting plate 26. The mounting structure 184 may comprise a pair of cylindrical mounts 190 supporting an L-shaped bar 192. Threaded rods 185 extend through the L-shaped bar 192, the mounts 190 and the mounting holes in the mounting plate 26. The rods 185 are fitted with a pair of threaded nuts 196 disposed on opposite sides of the mounting plate 26, thereby securing the mounting structure 184 to the mounting plate 26. The rods 185 may also provide electrical connections between the mounting structure 184 and the neutral terminal of the transformer.

The third retrofit contact structure 186 includes a contact head 194 secured to a base 196 by bolts 198. The base 196 may simply rest on the mounting plate 26, or new holes may be formed in the mounting plate 26 and the base 196 may be secured to the mounting plate 26 by bolts 198 that extend through the new mounting holes. The contact head 194 is constructed from a conductive metal, such as copper and may optionally be covered with one or more metallic coatings, such as silver. The contact head 194 includes a plate 200 joined to a curved or arcuate contact 202 having tapered ends and a generally circular cross-section.

The bus bar 188 is configured to locate (or permit the location of) the third retrofit contact structure 186 between the first and second retrofit contact structures 152, 154 such that the first, second and third retrofit contact structures 152, 154, 186 generally form a triangular configuration. In this regard, the bus bar 188 has a bent configuration, with an enlongated section secured to the L-shaped bar 192 and a shorter section secured to an end wall of the base 196 by a bolt 204. The interconnection of the mounting structure 184, the third retrofit contact structure 186 and the bus bar 188 forms an electrical path that electrically connects the contact head 194 to the neutral terminal of the transformer.

The retrofit contact arm 158 generally includes a contact assembly 206 mounted to an arm 210. The contact assembly 206 includes a contact housing 212, a plurality upper contact jaws 214 and a plurality of lower contact jaws 216. In the shown embodiments, there are three upper contact jaws 214 and three lower contact jaws 216. A different number of upper and lower contact jaws 214, 216, however, may be provided. For example, only two of each of the upper and lower contact jaws 214, 216 may be provided, or four of each of the upper and lower contact jaws 214, 216 may be provided. The upper contact jaws 214 are aligned with the lower contact jaws 216. The contact housing 212 has a rectangular cross-section and extends around the aligned upper and lower contact jaws 214, 216. Each of the upper and lower contact jaws 214, 216 is generally rectangular in shape and is constructed from a conductive metal, such as copper, which may optionally be coated with one or more metallic layers, such as silver. At opposing inner and outer ends of the upper contact jaws 214, elongated notches are respectively formed in the bottom edge of the upper contact jaws 214. Similarly, at opposing inner and outer ends of the lower contact jaws 216, elongated notches are respectively formed in the top edge of the lower contact jaws 216. The notches in the upper contact jaws 214 are aligned with the notches in the lower contact jaws 216 so as to form an inner groove 220 and an outer groove 222. A groove is formed in the center of each of the upper and lower contact jaws 214, 216. The grooves are aligned so as to form a passage between the aligned upper and lower contact jaws 214. A mounting pin 224 extends through the passage and is attached at its ends to opposing sides of the contact housing 212. The mounting pin 224 retains the upper and lower contact jaws 214, 216 in the contact housing 212 and maintains the alignment of the upper and lower contact jaws 214, 216. In addition, the mounting pin 224 forms a pivot axis about which each of the upper and lower contact jaws 214, 216 can pivot.

In a top portion of each upper contact jaw 214, an upper recess is formed at each of the inner and outer ends. Two bores extend downwardly from each upper recess. An inner guide plate 226 extends through the upper recesses at the inner ends of the upper contact jaws 214, while an outer guide plate 228 extends through the upper recesses at the outer ends of the upper contact jaws 214. The inner and outer guide plates 226, 228 abut an inner surface of a top wall of the contact housing 212. For each upper contact jaw 214, two inner springs 230 are mounted to posts on the inner guide plate 226 and extend into the inner bores in the upper contact jaw 214. Similarly, for each upper contact jaw 214, two outer springs 232 are mounted to posts on the outer guide plate 228 and extend into the outer bores in the upper contact jaw 214. The inner springs 230 bias the inner ends of the upper contact jaws 214 downwardly, while the outer springs 232 bias the outer ends of the upper contact jaws 214 downwardly.

In a bottom portion of each lower contact jaw 216, a lower recess is formed at each of the inner and outer ends. Two bores extend upwardly from each lower recess. An inner guide plate 236 extends through the lower recesses at the inner ends of the lower contact jaws 216, while an outer guide plate 238 extends through the lower recesses at the outer ends of the lower contact jaws 216. The inner and outer guide plates 236, 238 abut an inner surface of a bottom wall of the contact housing 212. For each lower contact jaw 216, two inner springs 240 are mounted to posts on the inner guide plate 236 and extend into the inner bores in the lower contact jaw 216. Similarly, for each lower contact jaw 216, two outer springs 242 are mounted to posts on the outer guide plate 238 and extend into the outer bores in the lower contact jaw 216. The inner springs 240 bias the inner ends of the lower contact jaws 216 upwardly, while the outer springs 242 bias the outer ends of the lower contact jaw 216 upwardly.

The arm 210 may be flat, as in the first embodiment, or bent, as in the second embodiment. An outer end of the arm 210 is secured to the top wall of the contact housing 212, while an inner end is secured to a rotatable post, which may be the post 50 from the first prior art reversing switch 10 or a new post 246 (as shown). The arm 210 positions the upper and lower contact jaws 214, 216 such that the contact 202 of the third retrofit contact structure 186 is disposed in the inner groove 220 formed by the inner and outer contact jaws 214, 216, while the contact 172 of either the first retrofit contact structure 152 or the second retrofit contact structure 154 may be disposed in the outer groove 222 formed by the inner and outer contact jaws 214, 216, as will be described below.

The post 246 is connected to the actuation device of the first load tap changer, which is operable to rotate the post 246 so as to move the retrofit contact arm 158 between first and second positions. The first and second positions of the retrofit contact arm 158 correspond to the first and second positions of the contact arm 18. As the retrofit contact arm 158 moves between the first and second positions, the retrofit contact arm 158 maintains electrical contact with the third retrofit contact structure 186, with the upper and lower contact jaws 214, 216 sliding over the contact 202 of the third retrofit contact structure 186. In the first position, the contact 172 of the first retrofit contact structure 152 is engaged with the inner and outer contact jaws 214, 216 inside the outer groove 222 formed by the same, thereby electrically connecting the first retrofit contact structure 152 to the retrofit contact arm 158 and, thus, through the bus bar structure 156, to the neutral terminal of the transformer. In the second position, the contact 172 of the second retrofit contact structure 154 is engaged with the inner and outer contact jaws 214, 216 inside the outer groove 222 formed by the same, thereby electrically connecting the second retrofit contact structure 154 to the retrofit contact arm 158 and, thus, through the bus bar structure 156, to the neutral terminal of the transformer.

The first and second retrofit contact structures 152, 154 and the mounting structure 184 of the bus bar structure 156 are arranged in an arc, with each of the foregoing being located at about the same radial distance from the post 246.

Second Retrofit Method

Also in accordance with the present invention, a second retrofit method is performed on the second load tap changer to replace the second prior art reversing switch 100 with a second retrofit reversing switch 250. The retrofit method begins with the removal of the second prior art reversing switch 100. The rods are unthreaded from the first, second and third contact structures 102, 104, 106 and the mounting plate 126. The first, second and third contact structures 102, 104, 106 are then removed. The arm assembly 132 is removed from post 140 or the post 140 is disconnected from the actuation device of the second load tap changer and both the post 140 and the arm assembly 132 is removed. Once the second prior art reversing switch 100 is removed, the mounting plate 126 may be cleaned with a solvent or other washing fluid to remove any coking or other debris.

Figure 8:
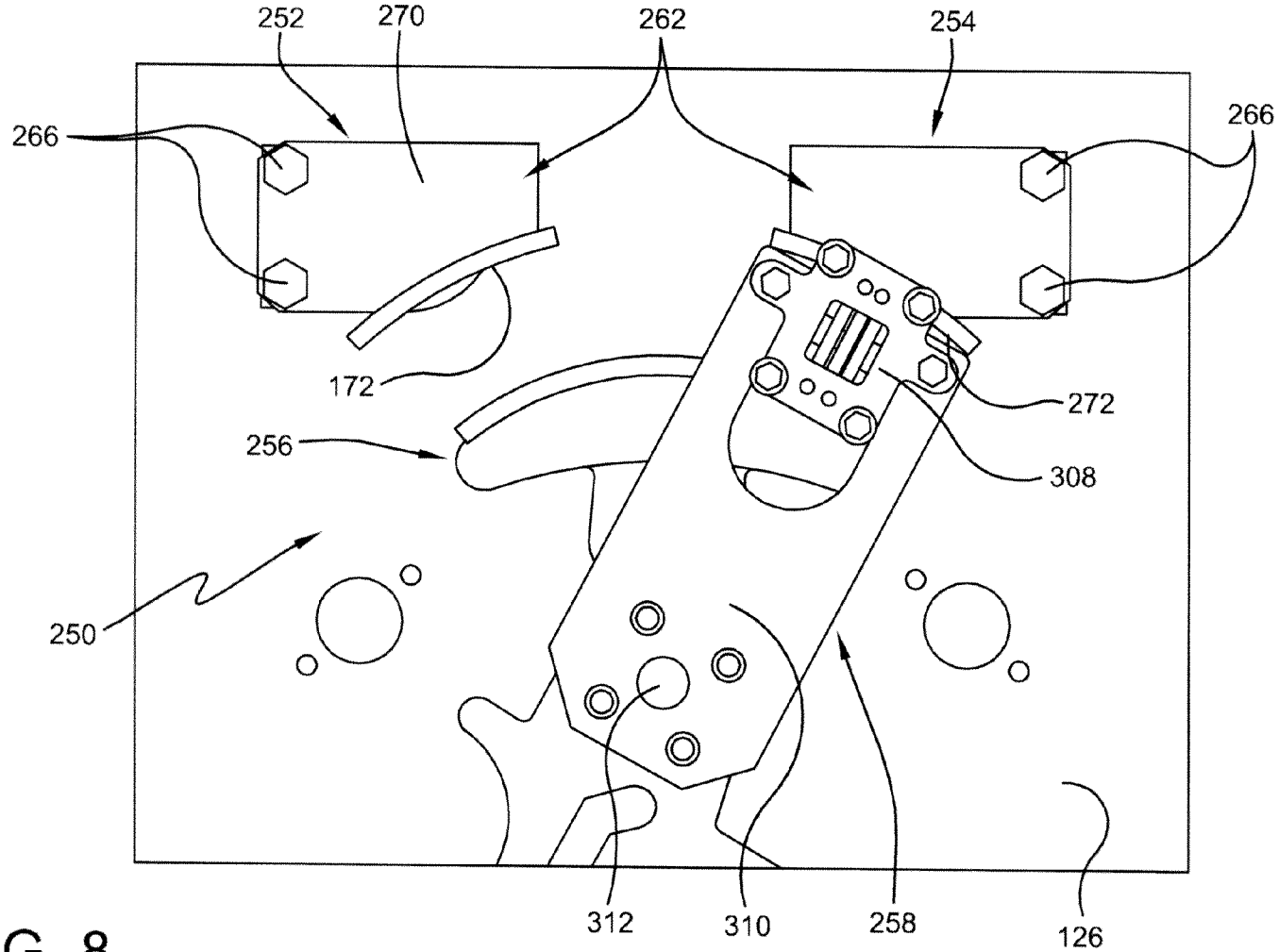
FIG. 8 shows a top plan view of a second retrofit reversing switch constructed in accordance with the present invention.
Figure 9:
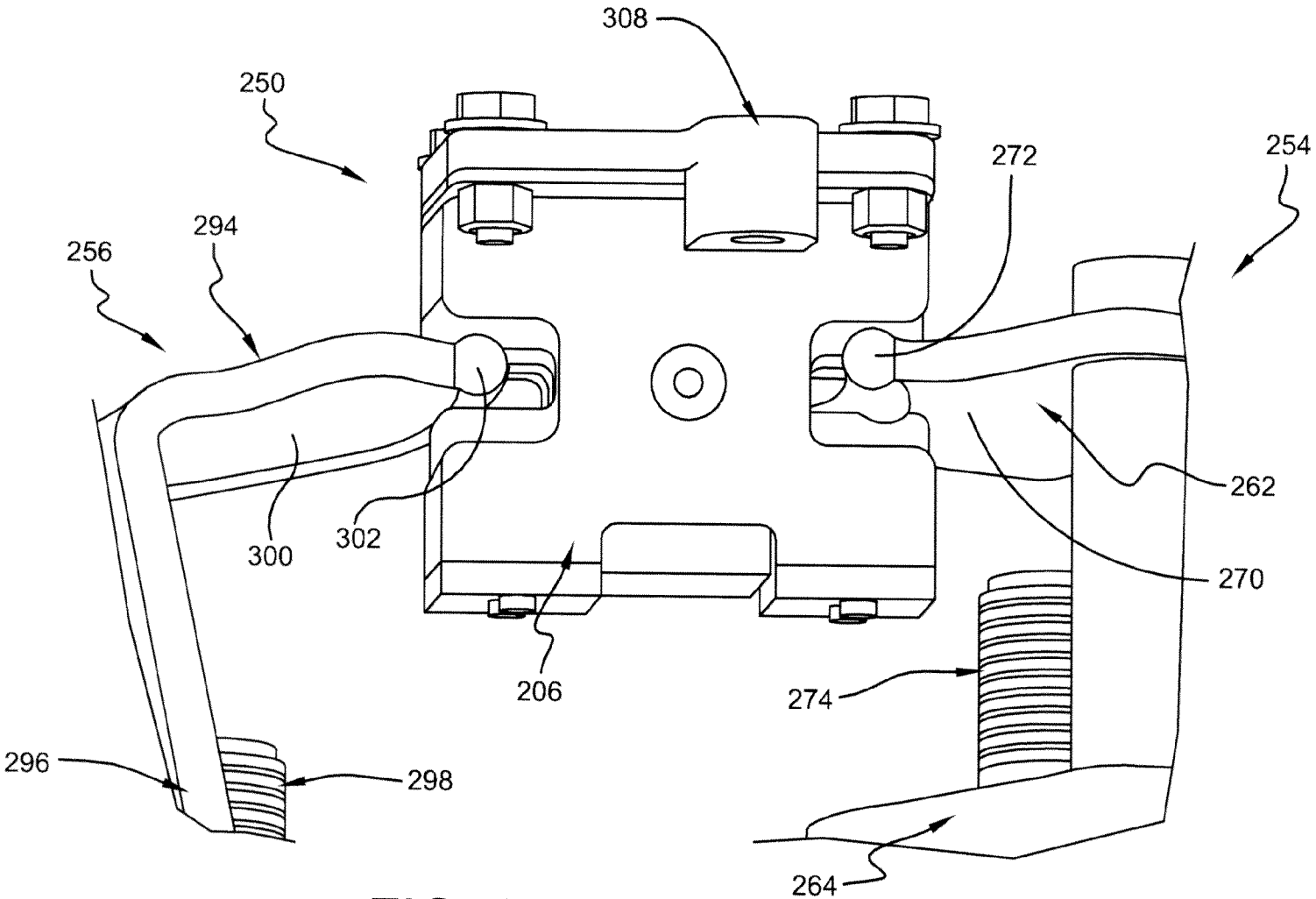
FIG. 9 shows a bottom side perspective view of a portion of the second retrofit reversing switch, wherein an arm of a retrofit contact arm is removed.

Once the second prior art reversing switch 100 is removed from the second load tap changer, the components of the second retrofit reversing switch 250 are mounted to the mounting plate 126. Referring now to FIGS. 8 and 9, the second retrofit reversing switch 250 generally includes a first retrofit contact structure 252, a second retrofit contact structure 254, a third retrofit contact structure 256 and a movable retrofit contact arm 258, all of which may be provided as a kit.

The first retrofit contact structure 252 is mounted at the same location as the first contact structure 102, using the same mounting holes in the mounting plate 126, while the second retrofit contact structure 254 is mounted at the same location as the second contact structure 104, using the same mounting holes in the mounting plate 126. The first and second retrofit contact structures 252, 254 are constructed of a conductive metal and each include a contact head 262 mounted in cantilever fashion to a support 264 by bolts 266. The contact head 262 is comprised of a metal, such as copper and may optionally be covered with one or more metallic coatings, such as silver. The contact head 262 includes an angular plate 270 joined to a curved or arcuate contact 272 having tapered ends. The arcuate contact 272 has a generally circular cross-section. The first and second retrofit contact structures 252, 254 may be mounted to the mounting plate 126 by threaded rods 274, which may also provide the electrical connections between the first and second retrofit contact structures 252, 254 and the ends of the series winding, respectively.

The third retrofit contact structure 256 is mounted at the same location as the third contact structure 106, using the same mounting holes in the mounting plate 126. The third retrofit contact structure 256 includes a contact head 294 secured to a base 296, which may be secured to the mounting plate 126 by threaded bolts or rods 298 that extend through the mounting holes in the mounting plate 126. The contact head 294 is constructed from a conductive metal, such as copper and may be coated with one or more other metallic layers, such as silver. The contact head 294 includes a plate 300 joined to a curved or arcuate contact 302 having tapered ends and a generally circular cross-section.

The retrofit contact arm 258 includes the contact assembly 206 mounted by a holding plate 308 to an arm 310. An inner end of the arm 310 is secured to a rotatable post, which may be the post 140 from the second prior art reversing switch 100 or a new post 312 (as shown). The arm 310 positions the upper and lower contact jaws 214, 216 such that the contact 302 of the third retrofit contact structure 256 is disposed in the inner groove 220 formed by the inner and outer contact jaws 214, 216, while the contact 272 of either the first retrofit contact structure 252 or the second retrofit contact structure 254 may be disposed in the outer groove 222 formed by the inner and outer contact jaws 214, 216, as will be described below.

The post 312 is connected to the actuation device of the second load tap changer, which is operable to rotate the post 312 so as to move the retrofit contact arm 258 between first and second positions. The first and second positions of the retrofit contact arm 258 correspond to the first and second positions of the arm assembly 132. As the retrofit contact arm 258 moves between the first and second positions, the retrofit contact arm 258 maintains electrical contact with the third retrofit contact structure 256, with the upper and lower contact jaws 214, 216 sliding over the contact 302 of the third retrofit contact structure 256. In the first position, the contact 272 of the first retrofit contact structure 252 is engaged with the inner and outer contact jaws 214, 216 inside the outer groove 222 formed by the same, thereby electrically connecting the first retrofit contact structure 252 to the retrofit contact arm 258 and, thus, the neutral terminal of the transformer. In the second position, the contact 272 of the second retrofit contact structure 254 is engaged with the inner and outer contact jaws 214, 216 inside the outer groove 222 formed by the same, thereby electrically connecting the second retrofit contact structure 254 to the retrofit contact arm 258 and, thus the neutral terminal of the transformer.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A reversing switch for a tap changer of a transformer, the reversing switch comprising:

a rotatable post;

first and second contact structures for connection to a winding of the transformer;

a mounting structure for connection to a neutral terminal of the transformer;

a third contact structure located closer to the post than the first and second contact structures and the mounting structure;

a bus bar connecting the third contact structure to the mounting structure;

a movable contact arm secured to the post and movable therewith between first and second positions, the contact arm including a contact assembly mounted to an arm, the contact assembly having one or more outward contacts and one or more inward contacts, the one or more inward contacts engaging the third contact structure and the one or more outward contacts engaging the first contact structure when the contact arm is in the first position and engaging the second contact structure when the contact arm is in the second position; and wherein the first contact structure, the second contact structure and the mounting structure are arranged in an arc, with the first contact structure, the second contact structure and the mounting structure each being located at about the same radial distance from the post.

2. The reversing switch of claim 1, wherein the contact assembly comprises at least one contact jaw pair, each contact jaw pair having an inner end and an outer end and comprising an upper contact jaw aligned over a lower contact jaw; and wherein the one or more inward contacts comprise the inner end of each contact jaw pair and the one or more outward contacts comprise the outer end of each contact jaw pair.

3. The reversing switch of claim 2, wherein the at least one contact jaw pair comprises a plurality of contact jaw pairs, and wherein for each contact jaw pair, at least one spring biases the upper and lower contact jaws toward each other.

4. The reversing switch of claim 2, wherein the contact assembly further comprises:

a housing surrounding the at least one contact jaw pair; and for each contact jaw pair, at least one spring biasing the upper and lower contact jaws toward each other.

5. The reversing switch of claim 4, wherein the contact assembly further comprises a mounting pin disposed between and extending normal to the upper and lower contact jaws in each contact jaw pair, the upper and lower contact jaws being pivotable about the mounting pin.

6. The reversing switch of claim 5, wherein the mounting pin is located midway between the inner and outer ends of each contact jaw pair.

7. The reversing switch of claim 5, wherein the at least one spring comprises:

inner springs biasing inner ends of the upper and lower contact jaws toward each other; and outer springs biasing outer ends of the upper and lower contact jaws toward each other.

8. The reversing switch of claim 7, wherein the inner springs comprise a first inner spring biasing the inner end of the upper contact jaw downwardly and a second inner spring biasing the inner end of the lower contact jaw upwardly; and wherein the outer springs comprise a first outer spring biasing the outer end of the upper contact jaw downwardly and a second outer spring biasing the outer end of the lower contact jaw upwardly.

9. The reversing switch of claim 8, wherein the at least one contact jaw pair comprises a plurality of contact jaw pairs.

10. The reversing switch of claim 9, wherein in each contact jaw pair, the upper and lower contact jaws cooperate with each other to define inner and outer grooves at the inner and outer ends of the contact jaw pair, respectively;

wherein the third contact structure extends through the inner grooves of the contact jaw pairs;

wherein when the contact arm is in the first position, the first contact structure extends through the outer grooves of the contact jaw pairs; and wherein when the contact arm is in the second position, the second contact structure extends through the outer grooves of the contact jaw pairs.

11. The reversing switch of claim 2, wherein in each contact jaw pair, the upper and lower contact jaws are each comprised of copper coated with silver.

12. A reversing switch for a tap changer of a transformer, the reversing switch comprising:

a rotatable post;

first and second contact structures for connection to a winding of the transformer;

a third contact structure located closer to the post than the first and second contact structures;

a mounting structure for connection to a neutral terminal of the transformer;

a bus bar connecting the third contact structure to the mounting structure; and a movable contact arm secured to the post and movable therewith between first and second positions, the contact arm comprising:

an arm;

a contact assembly mounted to the arm and comprising a plurality of contact jaw pairs, each contact jaw pair having an inner end and an outer end and including an upper contact jaw aligned over a lower contact jaw; and wherein the third contact structure is disposed between the upper and lower contact jaws at the inner end of each contact jaw pair;

wherein when the contact arm is in the first position, the first contact structure extends between the upper and lower contact jaws at the outer end of each contact jaw pair; and wherein when the contact arm is in the second position, the second contact structure extends between the upper and lower contact jaws at the outer end of each contact jaw pair.

13. The reversing switch of claim 12, wherein the first contact structure, the second contact structure and the mounting structure are arranged in an arc, with the first contact structure, the second contact structure and the mounting structure each being located at about the same radial distance from the post.

14. The reversing switch of claim 12, wherein the contact assembly further comprises:

a housing surrounding the contact jaw pairs;

for each contact jaw pair, at least one spring biasing the upper and lower contact jaws toward each other; and a mounting pin disposed between and extending normal to the upper and lower contact jaws in each contact jaw pair, the upper and lower contact jaws being pivotable about the mounting pin.

15. The reversing switch of claim 14, wherein for each contact jaw pair, the at least one spring comprises:

inner springs biasing inner ends of the upper and lower contact jaws toward each other; and outer springs biasing outer ends of the upper and lower contact jaws toward each other.

16. A method of modifying a tap changer of a transformer to replace a first reversing switch with a second reversing switch, the first reversing switch comprising: a contact arm mounted to a mounting plate of the tap changer and movable about an axis; first and second contact structures mounted to the mounting plate and connected to a winding of the transformer; and a third contact structure mounted to the mounting plate and connected to a neutral terminal of the transformer, the method comprising:

removing the contact arm of the first reversing switch from the mounting plate;

removing the first contact structure of the first reversing switch from the mounting plate;

removing the second contact structure of the first reversing switch from the mounting plate; and removing the third contact structure of the first reversing switch from the mounting plate;

securing a first contact structure of the second reversing switch to the mounting plate at about the same location as where the first contact structure of the first reversing switch was mounted to the mounting plate;

securing a second contact structure of the second reversing switch to the mounting plate at about the same location as where the second contact structure of the first reversing switch was mounted to the mounting plate;

securing a mounting structure of the second reversing switch to the mounting plate at about the same location as where the third contact structure of the first reversing switch was mounted to the mounting plate;

connecting a third contact structure of the second reversing switch to the mounting structure with a bus bar;

connecting the first contact structure of the second reversing switch to the winding of the transformer;

connecting the second contact structure of the second reversing switch to the winding of the transformer;

connecting the mounting structure of the second reversing switch to the neutral terminal of the transformer; and mounting a contact arm of the second reversing switch to the mounting plate so as to be pivotable about the axis between first and second positions, the contact arm comprising: a contact assembly mounted to an arm, the contact assembly having one or more outward contacts and one or more inward contacts, and wherein when the second reversing switch is fully installed, the one or more inward contacts engage the third contact structure and the one or more outward contacts engage the first contact structure when the contact arm is in the first position and engage the second contact structure when the contact arm is in the second position.

17. The method of claim 16, wherein the steps of removing the contact arm, the first contact structure, the second contact structure and the third contact structure of the first reversing switch are performed before any of the first contact structure, the second contact structure and the mounting structure of the second reversing switch are secured to the mounting plate.

18. The method of claim 17, wherein the method further comprises the step of cleaning the mounting plate after the contact arm, the first contact structure, the second contact structure and the third contact structure of the first reversing switch are removed from the mounting plate.

19. The method of claim 16, wherein the contact assembly of the second reversing switch comprises at least one contact jaw pair, each contact jaw pair having an inner end and an outer end and comprising an upper contact jaw aligned over a lower contact jaw; and wherein the one or more inward contacts comprise the inner end of each contact jaw pair and the one or more outward contacts comprise the outer end of each contact jaw pair.

20. The method of claim 16, further comprising securing the third contact structure of the second reversing switch to the mounting plate of the tap changer with bolts.

* * * * *